US008061033B2

(12) United States Patent
West

(10) Patent No.: US 8,061,033 B2
(45) **Date of Patent: *Nov. 22, 2011**

(54) METHODS OF MAKING TUNGSTEN CARBIDE-BASED ANNULAR JEWELRY RINGS

(76) Inventor: Trent West, Aptos, CA (US)

( * ) Notice: Subject to any disclaimer, the term of this patent is extended or adjusted under 35 U.S.C. 154(b) by 31 days.

This patent is subject to a terminal disclaimer.

(21) Appl. No.: 12/844,639

(22) Filed: Jul. 27, 2010

(65) Prior Publication Data

US 2010/0307005 A1 Dec. 9, 2010

Related U.S. Application Data

(60) Continuation of application No. 11/347,304, filed on Feb. 6, 2006, now Pat. No. 7,761,996, which is a continuation of application No. 10/410,656, filed on Apr. 8, 2003, now Pat. No. 6,993,842, which is a division of application No. 09/571,583, filed on May 15, 2000, now Pat. No. 6,553,667, which is a continuation-in-part of application No. 09/149,796, filed on Sep. 8, 1998, now Pat. No. 6,062,045.

(60) Provisional application No. 60/058,136, filed on Sep. 8, 1997.

(51) Int. Cl.
*A44C 27/00* (2006.01)

(52) U.S. Cl. ..... 29/896.412; 29/896.4; 29/896.41; 63/15; 419/15

(58) Field of Classification Search ..... 29/896.412, 29/896.4, 896.41; 63/15; D11/26, 37, 39; 419/15

See application file for complete search history.

(56) References Cited

U.S. PATENT DOCUMENTS

| | | | |
|---|---|---|---|
| D33,674 | S | 12/1900 | Bliss, Jr. |
| 1,192,983 | A | 8/1916 | Bruderer |
| 1,254,791 | A | 1/1918 | Ganzinotti |
| D53,040 | S | 3/1919 | Krope |
| 1,327,606 | A | 1/1920 | Bacharach |
| 1,431,652 | A | 10/1922 | Grossman |
| 1,537,068 | A | 5/1925 | Croselmire |
| 1,551,333 | A | 8/1925 | Schrotter et al. |
| 1,594,885 | A | 8/1926 | Kaplan |

(Continued)

FOREIGN PATENT DOCUMENTS

| | | |
|---|---|---|
| AU | 208883 | 5/1957 |

(Continued)

OTHER PUBLICATIONS

Schedler, Wolfgang. Carbide Metal for the Practitioner: Composition, production, properties and industrial application of a modern class of metals. Dusseldorf, Germany, 1988 (English Translation of pp. 528-530).

(Continued)

*Primary Examiner* — Richard Chang
(74) *Attorney, Agent, or Firm* — Wiley Rein LLP; Scott A. Felder

(57) ABSTRACT

Methods of making tungsten carbide-based annular jewelry rings including sinterable metal and/or ceramic powder materials compressed into a predetermined configuration and then sintered to form an annular jewelry ring to which softer precious metals, stones, crystals or other materials suitable for use in jewelry may be affixed. Such items of jewelry may have multiple facets and can be fabricated using various disclosed techniques and various combinations of materials.

4 Claims, 12 Drawing Sheets

U.S. PATENT DOCUMENTS

| | | | | |
|---|---|---|---|---|
| 1,597,589 | A | 8/1926 | Ferrari | |
| 1,654,335 | A | 12/1927 | Lindroth | |
| 1,689,124 | A | 10/1928 | Fitzgerald | |
| 1,863,618 | A | 5/1932 | Brogan | |
| 2,016,679 | A | 10/1935 | Mayer | |
| 2,027,060 | A | 1/1936 | Niven et al. | |
| 2,050,253 | A | 8/1936 | Bager | |
| 2,126,737 | A | 8/1938 | Comstock | |
| 2,128,644 | A | 8/1938 | Gittler | |
| D113,692 | S | 3/1939 | Wittmayer | |
| 2,161,549 | A | 6/1939 | Most | |
| 2,332,344 | A | 10/1943 | Roskin | |
| 2,450,762 | A | 10/1943 | Marshall | |
| D137,743 | S | 3/1944 | Frackman | |
| 2,747,259 | A | 5/1956 | Brioux | |
| 3,242,664 | A | 3/1966 | Lederrey | |
| 3,409,416 | A | 11/1968 | Yates | |
| 3,409,417 | A | 11/1968 | Yates | |
| 3,409,418 | A | 11/1968 | Yates | |
| 3,409,419 | A | 11/1968 | Yates | |
| 3,413,392 | A | 11/1968 | Meadows | |
| 3,417,223 | A | 12/1968 | Steigerwald | |
| 3,606,766 | A | 9/1971 | Hill | |
| 3,669,695 | A | 6/1972 | Iler | |
| 3,712,079 | A | 1/1973 | Eberle | |
| 3,719,479 | A | 3/1973 | Flanagan | |
| 3,725,634 | A | 4/1973 | Lane | |
| 3,776,706 | A | 12/1973 | Daniels et al. | |
| 3,837,163 | A | 9/1974 | Fujimori | |
| 3,841,848 | A | 10/1974 | Kasai et al. | |
| 3,901,717 | A | 8/1975 | Revaz | |
| 3,958,070 | A | 5/1976 | Schintlmeister et al. | |
| 4,090,284 | A | 5/1978 | Kraft | |
| 4,124,665 | A | 11/1978 | Petersen et al. | |
| 4,281,235 | A | 7/1981 | Peloquin | |
| 4,387,627 | A | 6/1983 | Avezou | |
| 4,549,058 | A | 10/1985 | DelMastro et al. | |
| 4,574,011 | A | 3/1986 | Bonjour et al. | |
| 4,740,935 | A | 4/1988 | Gogniat | |
| 4,797,326 | A | 1/1989 | Csillag | |
| 4,891,276 | A | 1/1990 | Exner | |
| D307,149 | S | 4/1990 | Niebauer | |
| 5,003,678 | A | 4/1991 | Oganesyan | |
| 5,431,028 | A | 7/1995 | Lampert | |
| D363,727 | S | 10/1995 | DeRoche | |
| 5,462,772 | A | 10/1995 | Lemelson | |
| 5,678,428 | A | 10/1997 | Pasquetti | |
| 5,968,428 | A | 10/1999 | Kuwabara | |
| 6,020,826 | A | 2/2000 | Rein | |
| 6,062,045 | A | 5/2000 | West | |
| D435,475 | S | 12/2000 | Canty | |
| 6,260,383 | B1 | 7/2001 | Warren et al. | |
| 6,546,749 | B1 | 4/2003 | Canty | |
| 6,553,667 | B1 | 4/2003 | West | |
| 6,641,640 | B1 | 11/2003 | Hesse et al. | |
| 6,928,734 | B1 | 8/2005 | West | |
| 6,990,736 | B2 | 1/2006 | West | |
| 6,993,842 | B2 * | 2/2006 | West | 29/896.412 |
| 7,032,314 | B2 | 4/2006 | West | |
| 7,076,972 | B2 | 7/2006 | West | |
| 7,761,996 | B2 * | 7/2010 | West | 29/896.412 |

FOREIGN PATENT DOCUMENTS

| | | | |
|---|---|---|---|
| CH | 514680 | | 10/1971 |
| FR | 0679812 | | 4/1930 |
| FR | 2495509 | | 6/1992 |
| GB | 1282009 | | 7/1972 |
| GB | 2210249 | | 6/1989 |
| GB | 950127 | | 11/2010 |
| JP | 56084375 | A | 7/1981 |
| JP | 59076801 | | 5/1984 |
| JP | 61177357 | | 8/1985 |
| JP | 61177351 | | 8/1986 |
| JP | 64008245 | | 1/1989 |
| JP | 9268241 | | 10/1997 |
| WO | 9617319 | | 6/1996 |
| WO | 9912443 | | 3/1999 |
| WO | 0221962 | | 3/2002 |

OTHER PUBLICATIONS

"Custom Ring Designs Handcrafting" (Bates JCPC INVCOOOOOI), USA/ website: http://www.customringdesigns.com/tungstenrings. htm.

Kennametal Inc., "Designing with Kennametal", (Bates JCPC INVC000012), USA/Kennametal Inc. (Nov. 1956).

Kennametal Inc., "Designing with Kennametal", (Bates JCPC INVC000015), USA/Kennametal Inc. (1969).

"Titanium and tungsten Carbide" (Bates JPC INVC000043), USA/ website: http://www.overstock.com/alternative metals-buying-guide.html., Jan. 9, 2009.

Kennemetal Inc., "Properties and Proven Uses of Kennametal Hard Carbide Alloys" (Bates JCPC INVC000046) USA/ Kennametal Inc.

General Electric, "Trends and Developments for Design Engineers with Carboloy Cemented Carbides and Oxide" USA (1958).

Tungsten Pride "Welcome to Tungsten Pride" www.tungstenpride.com/ContactUs.aspx.

Spectore Corp., "Spector Corporation", USA 1983.

Jewelry Innovations, Inc. and Tosyali International, Ltd.'s [Proposed] Amended Preliminary Invalidity *Contentions* v. *Trent West* (Case No. C 07 1812 EDL, N.D. Cal.), Filed Aug. 28, 2008.

Defendant Crown Ring, Inc.'s [Proposed] Second Amended Preliminary Invalidity *Contentions* v. *Trent West* (Case No. C 5: 07-cv-01812-JF (HRL), Filed Nov. 17, 2008.

ASM Handbook vol. 7: Powder Metal Technologies and Applications (Bates No. C&C002863-2873). ASM International, 1998.

Brookes, Kenneth J. A., "World Directory and Handbook of Hardmetals" (Bates No. C&C002874-2877), UK International Carbide Data, 1975.

James, P.J., "Isostatic Pressing Technology", (Bates No. C&C3007-3010), UK Applied Science Publishers, 1983.

Lassner. Eric, et al., "Tungsten Properties, Chemistry, Technology of the Element, Alloys and Chemical Compounds" (Bates No. CBC003011-3177), Kluwer AcademicIPlenum Publishers, 1999.

Lenel, Fritz .V., "Powder Metallurgy Principles and Applications", (Bates No. C&C003178-3181). USIMetal Powder Industries Federation, 1980.

Parker, Sybil P., "McGraw-Hill Encyclopedia of Engineering 2nd edition, Powder Metallurgy", (Bates No. C&C 003182-31 88) McGraw-Hill 1993.

Popper, Paul, "Isostatic Processing", Isostatic Processing, (Bates No. C&C003189-3194). UK Heyden & Son Ltd.. 1976.

Schwarzkopf, Dr. Paul, et al., "Cemented Carbides", (Bates No. C&C003195-3334), USA, The MacMillan Company, 1960.

Upadhyaya. Gopal S., "Cemented Tungsten Carbides". (BatesC &C003335-3339), USINoyes Publications, 1998 (Indian Institute, Kanpur, IN).

Yin, Stephen W. H., et al.. "Tungsten Sources, Metallurgy, Properties and Applications" (Bates No. C&C003340-3417) , Plenum Press (NYILondon).

Raghunathan, et al., "Tungsten Carbide Technologies", (Bates No. C&C3418-3422), Advanced Materials & Processes, Apr. 1996, pp. 21-23.

Aiken Industries, Inc., "Carbidie". (Bates No. C&C003423-3442), stamped Feb. 24, 1969 received, Carbidie, USA.

General Electric, "Carboloy Cemented Carbide Standard and Special Dies for Wire Bar and Tub Drawing", (Bates No. C&C003511-3542). USA, 1952.

General Electric, Carboloy Cemented Carbide Die Engineering Manual, (Bates No. C&C003543-3594), USA, General Electric Manual, 1957.

Carboloy Corp., "Carboloy G-10 Drawing", USA 1946.

General Electric Co., "Carboloy Die Service Manual (D-119)", (Bates No. C&C003616-3682), USA Oct. 1, 1945.

Noral Diamond Jewelers & GCI, "The Hardwear Collection" (Bates No. C&C003780-3787), USA.

Kennametal Inc., "Kennametal Carbide Grades-Properties and Applications Guide", (Bates No. C&C00003788-3791) USA/Kennametal Inc. 1987.
Kennametal Inc., "Kennametal Offers Stiff Resistance", (Bates No. C&C00003792-3798) USA/Kennametal Inc. 1985.
Kennametal Inc.. (Bates No. C&C003799-3818) USA/Kennametal Inc. 1985.
General Carbide Corporation, "Products and Facilities", (Bates No. (C&C003819-3840).
Kennametal Inc., "Properties of Kennametal Hard Carbide Alloys" (Bates No. C&C003893-3919) USNKennametal, Inc.
General Electric. "Carboloy Cemented Carbide Standard and Species Dies for Wire, Bar and Tube Drawing", (Bates No. C&C003921-3952). USNGeneral Electric Catalog, Dec. 15, 1952.
Tungsten Alloy, "Cemented Carbides Powder to Product" (Bates No. C&C003969-4019). USMungsten Alloy Catalog.
Metal Carbides Corp., "Tungsten Carbide Rolls for Cold Rolling Metals", (Bates No. C&C 004020-4039), USA Sep. 1, 1950.
Carboloy Cemented Carbide Hard Metal "Wear Resistant Applications" (p. 49) (Bates Nos. C&C004040).
Matched Spinning Set, "Tungsten Carbide Fishing Guides" Carbide Rings Next to Diamond in Hardness (Bates No. C&C004053-4054). USA 1947.
Kennametal Corp. 1600 Technology Way Latrobe, PA, "Tungsten Carbide Tie Tacks" (Bates No. C&C004055-4072), USA 1993.
Rado Corp. Switzerland, "Tungsten Carbide Watches and Jewelry Products" Switzerland, 1979 (Bates No. C&C004076-4078).
Kagan Corp., Swaging Technology (Kagan Rollers), USA 1947 (Bates No. C&C004092-4093).
Carboloy Corp., "Tungsten Carbide Guide Rings" USA 1947 (Bates No. C&C004094).
The American Heritage Dictionary of the English Language, Fourth Edition, 2000 (Definitions of "ring" and "annular").
Titanium Era Webpage. [Available] http:Nwww.titaniumera.com/tungsten.html; O 1994-2003.
Progressive Jewelers.com Webpage [Available] http://www.progressivejewelers.com/tungsteninlays.htm; © 2003.
Boccia® Titanium, The Boccia Titanium Jewelry Collection, Universal Watch Co., Inc., Framingham, MA 0 1702, Aug. 6, 2002.
Sharr Choate, "Creative Gold- and Silversmithing," 1970, pp. 58-68, 139-150, 165-170, 188,245-264.
Carboloy Co., "Carboloy Cemented Carbide Catalong" (Bates No. C&C 003443-3510) USA, Sep. 29, 1947.
General Electric, "Carboloy Cemented Carbide Die Products Standard Dies & Die Metal", (Bates No. C&C003595-3615), USA Catalog (D-160), Jan. 1960.
Spectore Corp., "Spectore Corporation Rings and Drawings" USA 1983 (Bates No. C&C004079-4091).
Decision on Appeal, Appeal No. 2009-006792 (U.S. Appl. No. 11/487,456), Jul. 30, 2010.

* cited by examiner

METHODS OF MAKING TUNGSTEN CARBIDE-BASED ANNULAR JEWELRY RINGS

CROSS-REFERENCE TO RELATED APPLICATIONS

This application is a continuation of U.S. application Ser. No. 11/347,304, filed Feb. 6, 2006, now U.S. Pat. No. 7,761,996 now allowed, which is a continuation of U.S. application Ser. No. 10/410,656, filed Apr. 8, 2003, now U.S. Pat. No. 6,993,842, which is a divisional of U.S. application Ser. No. 09/571,583, filed May 15, 2000, now U.S. Pat. No. 6,553,667, which is a continuation-in-part of U.S. application Ser. No. 09/149,796, filed Sep. 8, 1998, now U.S. Pat. No. 6,062,045, which claims the benefit of Provisional Application No. 60/058,136, filed Sep. 8, 1997. The contents of each of these applications is incorporated herein by reference thereto.

FIELD OF THE INVENTION

The present invention relates generally to methods of making jewelry items such as finger rings, bracelets, earrings, body jewelry and the like, and more particularly to novel jewelry apparatus and methods of making same out of "hard" metals including tungsten carbide, either alone or in combination with precious metals and jewels such that the hardened materials protect the softer precious metals and jewels from edge and detail weardown.

BACKGROUND OF THE INVENTION

Jewelry has for centuries been made of soft materials such as gold, silver, platinum and other soft materials, because such metals were malleable, castable, forgeable, moldable or otherwise formable. However, whereas such materials are relatively easy to mold, shape and polish, they are equally subject to wear, scratching and other damage detracting from their longevity appearance and value, i.e., wearing down of edges to a smooth and rounded state.

More recently, science has produced other materials including tungsten, cemented carbide and high tech ceramics that are much harder than the previously mentioned precious metals, and once formed, are virtually indestructible when used in a normal jewelry wearing environment. The problem with such materials is that because of their hardness, they are very difficult to shape, and once formed, require special machining and/or grinding tools to alter their configuration and appearance. Accordingly, with the exception of articulated watch bands or housings for timepieces of the type made by Rado Watch Co. Ltd. of Switzerland, such materials have historically not been used for articles of jewelry of the types mentioned above. However, I have recently discovered that through the use of powder metallurgy and sintering processes, such materials can be manufactured and used to provide faceted designs that were not heretofore practiced. Furthermore, such materials can be used to enhance and protect precious metals and gemstones in this jewelry setting.

In the process of fabricating parts from powdered metals, the most important step is the one involving the welding together of the metallic powder to form a solid which will yield the proper shape and the properties required of the finished part. Although a good weld cannot be made between metals at room temperature by pressure alone, when the metal particles are relatively fine and plastic, a welding may occur that is satisfactory from the viewpoint of handling, although little or no strength will be developed. Under pressure, at room temperature, metal powders that are plastic and relatively free from oxide films, may be compacted to form a solid of the desired shape having a strength (green strength) that allows the part to be handled. This result is often called cold-welding. The welding under pressure of the metal particles in order form a solid blank of the shape desired, requires the use of pressures varying from 5 to 100 tons/in$^2$. Relatively light loads are used for the molding of the softer and more plastic metals, while pressures approaching 100 tons/in$^2$ are necessary when maximum density is needed and when pressing relatively hard and fine metal powders such as those used in accordance with the present invention.

Commercial pressing is done in a variety of presses which may be of the single mechanical punch-press type or the double—action type of machine that allows pressing from two directions by moving upper and lower punches synchronized by means of cams. These machines also incorporate moveable core rods which make it possible to mold parts having long cores, assist in obtaining proper die fills and help in the ejection of the pressed parts.

The molding of small parts at great speeds and at relatively low pressures can be accomplished using the mechanical press. For example, mechanical presses can produce parts at the rate of 300 to 30,000 parts per hour. A satisfactory press should meet certain definite requirements among which are the following: (1) sufficient pressure should be available without excessive deflection of press members; (2) the press must have sufficient depth of fill to make a piece of required heights dependent upon the ratio of loose powder to the compressed volume, this being referred to as the compression ration; (3) a press should be designed with an upper or lower punch for each pressing level required in the finished part, although this may be taken care of by a die design with a shoulder or a spring mounted die which eliminates an extra punch in the press; and (4) a press should be designed to produce the number of parts required. The punches are usually made from an alloy of tungsten carbide or punched steel that can be hardened by oil quenching.

Heating of the cold-welded metal powder is called the "sintering" operation. The function of heat applied to the cold-welded powder is similar to the function of heat during a pressure-welding operation of steel in that it allows more freedom for the atoms and crystals; and it gives them an opportunity to recrystallize and remedy the cold deformation or distortion within the cold pressed part. The heating of any cold-worked or deformed metal will result in recrystallization and grain growth of the crystals or grains within the metal. This action is the same one that allows one to anneal any cold work-hardened metal and also allows one to pressure-weld metals. Therefore, a cold-welded powder will recrystallize upon heating, and upon further heating, the new crystals will grow, thus the crystal grains become larger and fewer.

The sintering temperatures employed for the welding together of cold-pressed powders vary with the compressive loads used, the type of powders, and the strength required of the finished part. Compacts of powders utilized in accordance with the present invention are typically sintered at temperatures ranging from about 1000° C. to in excess of 2000° C. for approximately 30 minutes. When a mixture of different powders is to be sintered after pressing and the individual metal powders in the compact have markedly different melting points, the sintering temperatures used may be above the melting point of one of the component powders. The metal with a low melting point will thus become liquid; however, so long as the essential part or major metal powder is not molten, this practice may be employed. When the solid phase or powder is soluble in the liquid metal a marked dilution of the solid metal through the liquid phase may occur which will develop a good union between the particles and result in a high density.

Most cold-pressed and metal ceramic powders shrink during the sintering operation. In general factors influencing shrinkage include particle size, pressure used in cold-welding, sintering temperature and time employed during the sintering operation. Powders that are hard to compress will cold-shrink less during sintering. It is possible to control the amount of shrinkage that occurs. By careful selection of the powder and determination of the correct pressure of cold-forming, it is possible to sinter so as to get minimal volume chance. The amount of shrinkage or volume change should be determined so as to allow for this change in the design of the dies used in the process of fabricating a given shape.

The most common types of furnace employed for the sintering of pressed powders is the continuous type. This type of furnace usually contains three zones. The first zone warms the pressed parts, and the protective atmosphere used in the furnaces purges the work of any air or oxygen that may be carried into the furnace by the work or trays. This zone may be cooled by water jackets surrounding the work. The second zone heats the work to the proper sintering temperature. The third zone has a water jacket that allows for rapid cooling of the work and the same protective atmosphere surrounds the work during the cooling cycle.

Protective atmospheres are essential to the successful sintering of pressed powders. The object of such an atmosphere is to protect the pressed powders from oxidation which would prevent the successfully welding together of the particles of metal powder. Also if a reducing protective atmosphere is employed, any oxidation that may be present on the powder particles will be removed and thus aide in the process of welding. A common atmosphere used for the protection and reduction of oxides is hydrogen. Water vapor should be removed from the hydrogen gas by activated alumina dryers or refrigerators before it enters the furnace.

Many of the same problems and limitations experienced in the jewelry industry also pertain to the medical, dental, industrial, and scientific fields where there is a need for articles having particular structural and/or metallurgical or compositional properties have been difficult to manufacture.

Therefore there remains a need for articles having properties that are best met using composite materials, and methods, apparatus, and systems for making such articles.

SUMMARY OF THE INVENTION

The invention encompasses a method of making a finger ring by providing an annular finger ring that defines an aperture configured and dimensioned to receive a person's finger and which includes a sintered mixture of at least two powdered materials comprising predominantly tungsten carbide and a relatively lesser amount of a metal binder component, with the annular ring having at least one external facet, and finishing the at least one external facet to a predetermined shape to provide a finish to a portion of the finger ring, with the sintered mixture retaining the predetermined shape and finish for the lifetime of the jewelry ring.

The invention also encompasses a method of making a jewelry article by providing an annular tungsten carbide-based ring including a sintered material that includes predominantly tungsten carbide and a metal binder component in a relatively lesser amount, and having an outer surface and a depression disposed circumferentially in its outer surface, providing an elongated decorative metal insert sized and dimensioned to at least partially fit into the depression, and disposing the elongated decorative metal insert at least partially into the depression to cause the metal insert to at least substantially fill the depression so as to form the jewelry article, wherein the annular tungsten carbide-based ring is sufficiently hard to avoid being deformed after being provided.

The invention relates to a jewelry article having an annular body formed of tungsten carbide. The annular body has at least one external face that is ground to a predetermined shape. The tungsten carbide is long wearing and virtually indestructible during normal use.

In a preferred embodiment, the article is a finger ring having at least two frusto-conically shaped facets extending around its outer circumference and a cylindrically shaped exterior portion forming a third surface. Other embodiments may include facets having surface angles of 1 to 40 degrees relative to the axis of symmetry of the body. Various surfaces of the ring may be ground to a mirror finish. Additional embodiments may include additional facets.

In general, the hard material of the invention will typically have a density of at least 13.3 g/cm$^3$. In one embodiment, the density is at most 15.1 g/cm$^3$. In one embodiment, the hard material includes predominantly sintered tungsten carbide, preferably including at least 85 weight % tungsten carbide. In one embodiment, the hard material includes sintered tungsten carbide and at least one binder. In one embodiment, the hard material includes sintered tungsten carbide and chromium carbide. In another embodiment, the hard material includes sintered tungsten carbide and nickel, while in another it includes sintered tungsten carbide and cobalt. In a preferred embodiment, the hard material includes sintered tungsten carbide, chromium carbide, nickel, and cobalt.

Various embodiments of the invention may include cavities that may be grooves, slots, notches, or holes wherein a precious metal or gemstone may be inserted. The jewelry article may also be in the form of a ring, earring, or bracelet and may include design details that are maintained in their original configuration indefinitely. The jewelry article will no require additional polishing during use.

BRIEF DESCRIPTION OF THE DRAWINGS

These and various other features and advantages of the present invention will be apparent upon reading of the following detailed description in conjunction with the accompanying drawings, where.

DETAILED DESCRIPTION OF THE PREFERRED EMBODIMENTS

The invention includes system, apparatus, and method for making composite articles particularly to an apparatus and method for manufacturing an article having a hard, wear-resistant component and a softer, more malleable component. One such article is an article made from "hard" metals and/or ceramic materials either alone or in combination with precious metals and jewels such that the hardened materials protect the softer precious metals and jewels from edge and detail wear down. Jewelry items such as finger rings, bracelets, earrings, body jewelry, and the like, are one particular example of such articles. Medical, dental, and industrial devices or components are other examples of such articles. Furthermore, while the manufacturing method or process is particularly well suited to articles having a wear resistant component and a softer wearable component, the inventive method is not limited to such hard and soft constituents. The broad applicability of the inventive articles and method for making such articles will become more apparent in light of the description and drawings provided herein.

Figure 1:
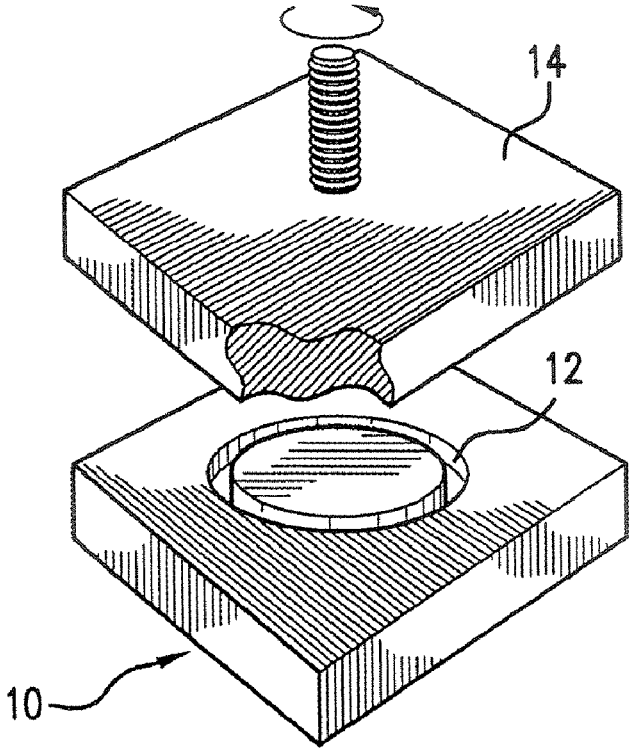
FIG. 1 is a diagram schematically illustrating a press mold of a type used to make jewelry articles in accordance with the present invention.

Referring now to FIG. 1 of the drawing, a compressive mold is depicted at 10 including an annular cavity 12 generally illustrated and configured to receive a quantity of powdered, hard metal or high tech ceramic material that can be compressed and formed into an oversized "green" ring blank by the application of compressive forces applied by a mating press member 14. The mold 10 may be made in any configuration suitable for forming a particular annular or other shape, and the illustrated cavity is sized to as to produce an annular blank that, following shrinkage during subsequent processing, will have a predetermined size and configuration. Numerous types of powdered materials can be used in accordance with the present invention. One such powder includes the following constituents:

| | |
|---|---|
| Nickel | 2% to 10% |
| Cobalt | 1% to 2% |
| Chromium or Chromium Carbide | 0.5% to 3% |
| Tungsten or Tungsten Carbide | balance |

Whereas in this example, Nickel and Cobalt are used as binder materials, other materials such as palladium, platinum, ruthenium, iridium and gold or alloys thereof, may also be used.

A ceramic composition might include:

| ZIRCONIA (wt. %) | |
|---|---|
| $ZrO_2 + HfO_2$ | 99% |
| $SiO_2$ | 0.20% |
| $TiO_2$ | 0.15% |
| $Fe_2O_3$ | 0.02% |
| $SO_3$ | 0.25% |
| LOI @ 1400° | 0.30% |

Whereas in this example, $ZrO_2$+$HfO_2$ is used as the matrix material, silicon nitrides, silicon carbides and other similar materials may be used. In addition, various castoring agents may be included in the binding materials.

Figure 2:
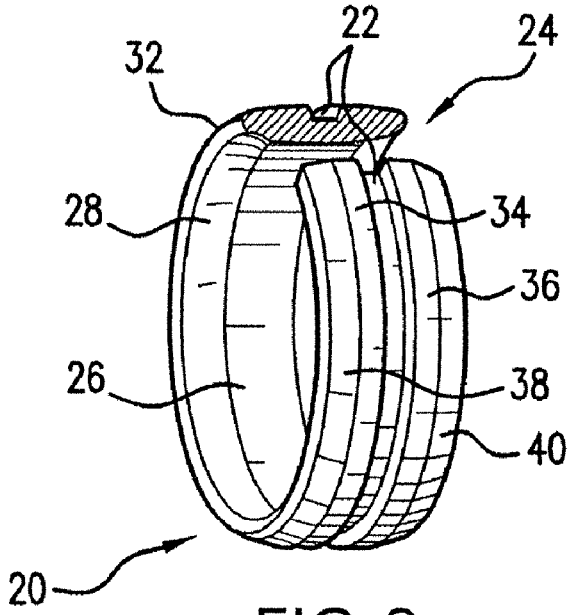
FIG. 2 is a partially broken perspective view illustrating details of one form of a molded ring component in accordance with the present invention.

In FIG. 2 of the drawing, one configuration of a ring is illustrated at 20 and includes an annular external grove 22 formed in the outer surface thereof. As illustrated in the cross-section shown in broken section at 24, the central-most portion 26 of the internal surface of the blank 20 is cylindrical with the outboard portions or facets 28 being angled relative thereto at angles typically in the range of from 1° to 30° relative to surface 26. The axial extremes of the cross-section of this embodiment are generally semicircular, as illustrated at 32, and the outer surface is configured to have cylindrical flats 34 and 36 on opposite sides of grove 22, and angled or frusto-conical shaped facets or flats 38 and 40 on the opposite sides thereof. As an alternative, the facets 38 and 40 may be configured to have multiple facet surfaces.

Figure 3:
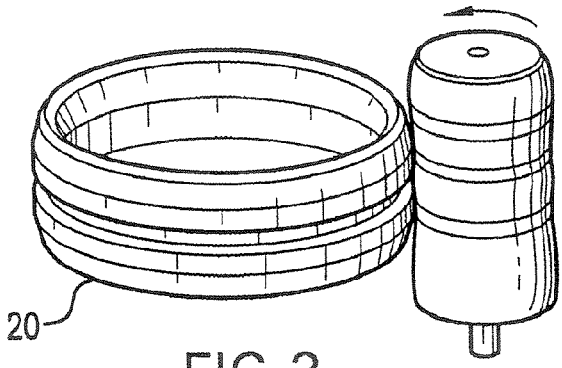
FIG. 3 is a perspective view illustrating one step in the preparation of a ring component in accordance with the present invention.
Figure 4:
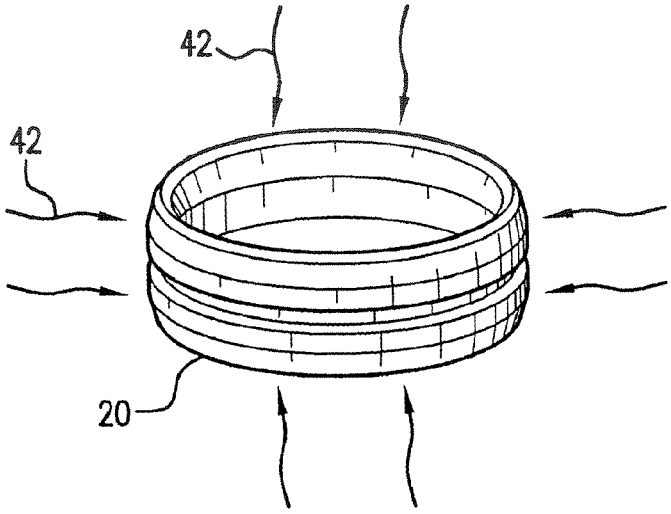
FIG. 4 is an illustration depicting a sintering step in accordance with the present invention.

Once removed from the mold, the blank 20 is shaped by machinery filing, sanding, trimming or other appropriate techniques and may be burnished as illustrated in FIG. 3 to provide a smooth or textured surface, and made ready for sintering. Once prepared, the blank 20 is inserted into a sintering oven and the temperature raised as suggested by the arrows 42, to a suitable sintering temperature for a predetermined period of time during which the blank becomes hardened and shrinks to a size appreciably smaller than the size of the original green blank. However, as indicated above, the mold was sized taking into consideration the anticipated subsequent shrinkage and as a result, the ring stock after sintering, has a predetermined size. This, of course, implies that a different mold will be required for each ring size. As an alternative, it will be understood that the blank may be pressed to have a tubular configuration from which multiple rings may be severed and machined to appropriate individual sizes.

Figure 5:
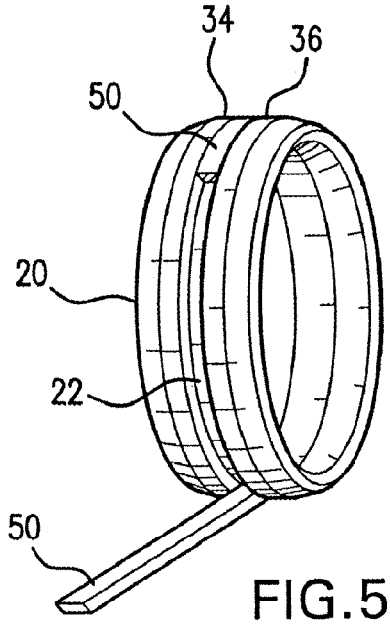
FIG. 5 is a perspective view illustrating one method of combining a precious metal component with a hard metal and/or ceramic component in accordance with the present invention.

Following the sintering operation, the ring stock can be ground and finish polished, and when appropriate, have a selected precious metal and/or other material installed in the groove 22 as suggested by the laying in of the soft metal strip 50 depicted in FIG. 5 of the drawings. Once the metal strip 50 is suitably installed using methods well known to jewelers, the assembly can be finish polished and made ready for market. It will, of course, be appreciated that other forms of materials can be inlaid into the groove 22. For example, preformed metal, stone, ceramic, shell or other segments could be glued or otherwise affixed to the ring. Preferably, such items will be slightly recessed below the surfaces of the facets 34 and 36 so as to be protected thereby.

Figure 6:
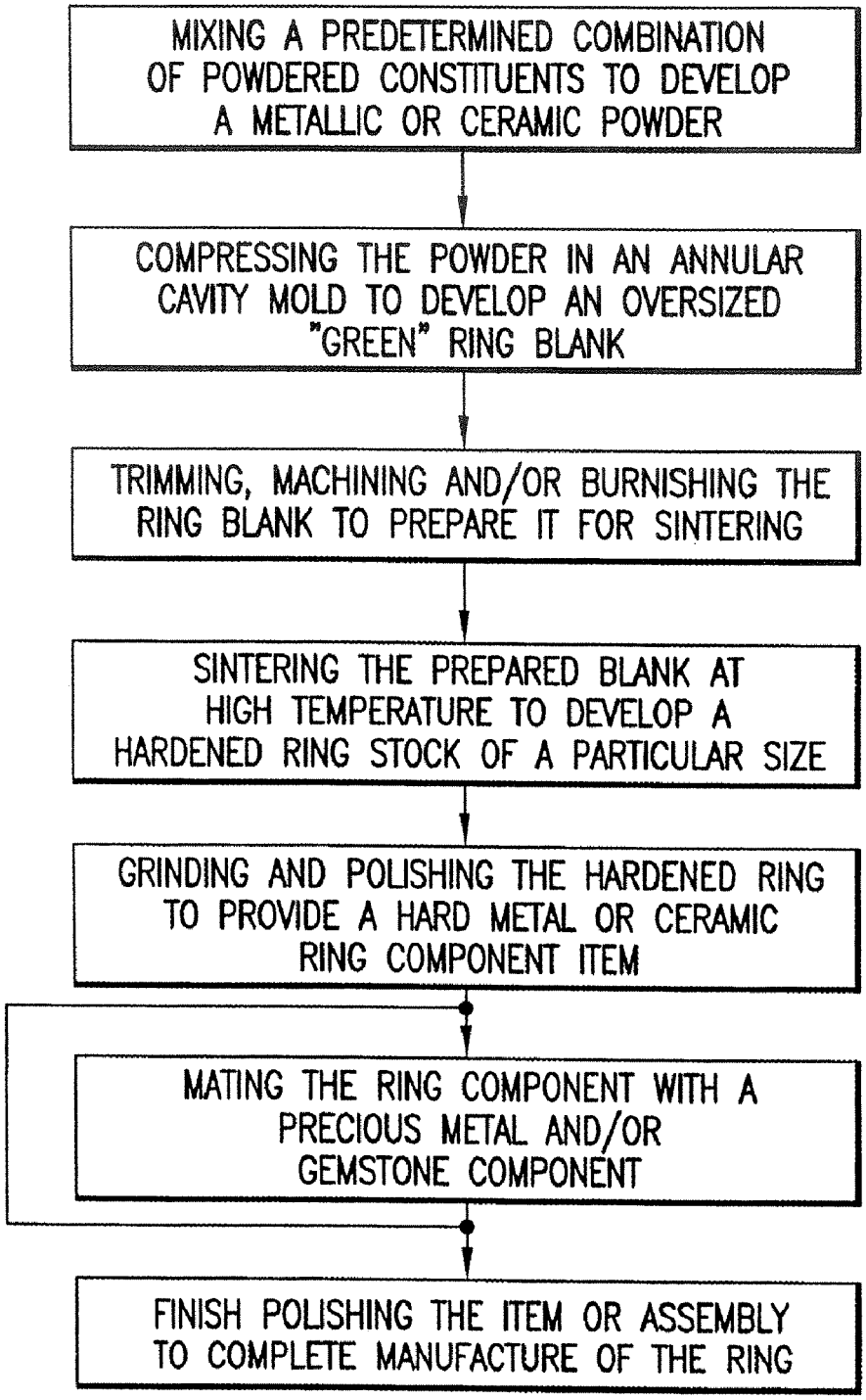
FIG. 6 is a flow chart illustrating steps followed to make jewelry in accordance with one embodiment of the present invention.
Figure 7:
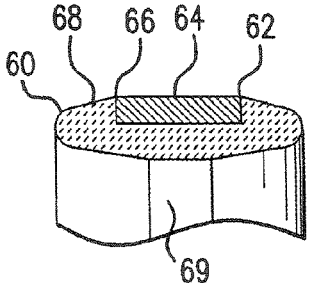
FIGS. 7-14 are partial cross-sections taken through various embodiments illustrating alternative forms of rings made in accordance with the present invention.

Turning now to FIG. 6, which is a flow diagram illustrating the various steps followed in a preferred method of making a ring in accordance with the present invention. It will be noted that once a suitable press and mold has been prepared, the first step in making a ring or other object is to mix a predetermined combination of powdered metal or ceramic constituents to develop a sinterable metallic or ceramic powder. Once properly measured and disposed within the mold cavity, the powder will be compressed by the mold to develop an oversized "green" ring blank that, although somewhat fragile, is stable enough to allow certain processing to be accomplished prior to sintering. For example, mold lines may be trimmed and smoothed, surfaces may be sanded or textured, facets may be smoothed, etc. But once properly prepared, the next step is to load the blank at room temperature into a non-atmospheric sintering chamber and raise the temperature thereof to controlled temperatures, typically varying between 1000° C. to 2000° C. and then slowly cooled back to atmospheric temperature. Once cooled, the hardened ring stock or other blank configuration can be ground and polished to provide the hard metal or ceramic ring component. At this point, precious metal components, jewels and other decoration components may be affixed to the hard metal or ceramic part. One way to affix precious metal to the part is to use a brazing process and provide the components in varied shapes of wire sheet tubing or segments of other material that can be fabricated or forged into appropriate configurations and flit into the mating groove or channel 22. Fluxed or flux free gold or silver soldered compounds varying in color and purity between 50% and 99% purity can be applied on or around desired mating surfaces of the hard material as well as the precious metal or other materials after mechanically binding the parts together with round or flat wire or heat resistant custom fixtures. Prepared fixtures with parts are then loaded at room temperature into a non-atmospheric chamber and heated to controlled temperatures varying between 1000° to 2000° C. and then allowed to cool down slowly to atmospheric temperature. This brazing operation will not interfere with the previously configured hard metal or ceramic components since their melting temperatures are substantially higher. A electron beam brazing process described herein may alternatively be used.

Another method of mating the precious metal or other components to the hardened component is to engineer the hardened component with various features such as holes, notches, slots, etc., such that various pre-shaped precious metal or other materials in mating configurations may be snapped or pressed, swaged or burnished into the hardened substructure. The resulting mechanical flit will hold the components together.

Still another method of mating the precious metal or other components to the hardened component is to bond them to the hardened part by means of one or two part hardening resin compounds that are heat and room temperature cured.

Also precious metals can be directly cast into cavities in hard metal or ceramic articles using lost wax techniques widely used in jewelry making.

But not withstanding the process used to mate the components together, once the several components are in fact combined, the entire assembly can be finished and polished to complete manufacture of the ring or other article of jewelry.

Turning now to FIGS. 7 through 14, various cross-sectional configurations of rings are depicted illustrating combinations of flats, facets, materials, inserts and component relationships. More specifically, in FIG. 7, a sintered metal part 60 is shown having a wide annular groove 62 formed in its outer surface and filled with a softer precious metal or other material 64. The top surface oft material 64 may be flush with the top edges 66 of the facets 68 or may be recessed there beneath to enhance the protective function of the hardened metal part 60. This ring might have an axial length of 2-14 mm, a wall thickness of 1-2.8 mm and have facets at angles of from about 2° to 40° relative to the cylindrical surface 69.

Figure 8:
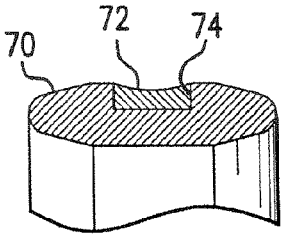

In FIG. 8, a similar ring design is depicted, but in this case, utilizing a ceramic material as the hard surfaced part 70 with the sculpted precious metal part 72 being mounted within a groove 74 formed in the outer perimeter of the hard part 70. Note the different surface effects that can be achieved by increasing the angular relationship of the various facets and by depressing or recessing the surface of the insert 72.

Figure 9:
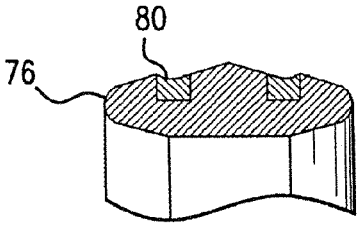
Figure 10:
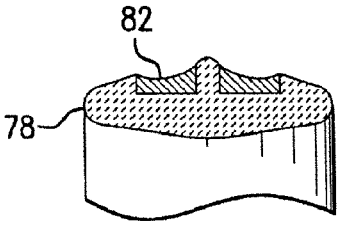

FIGS. 9-10 depict two-groove embodiments of both sintered metal and ceramic substructures at 76 and 78 respectively, each having precious metal or other inserts 80 and 82 formed in the annular grooves thereof, with the exterior surfaces of the inserts of the rings being treated differently to achieve substantially different visual effects. Note, that in either case, the "hard part" protects the softer precious metal part. Note that in the FIG. 10 embodiment, the internal surface 83 is shown aligned rather than faceted. Other embodiments may be treated likewise.

Figure 11:
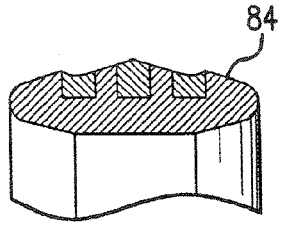

In FIG. 11, a three-groove embodiment is depicted at 84.

Figure 12:
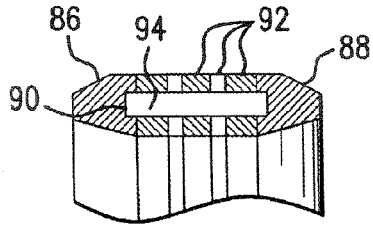
Figure 13:
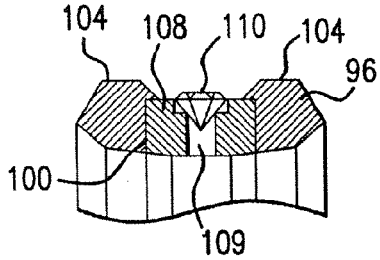
Figure 14:
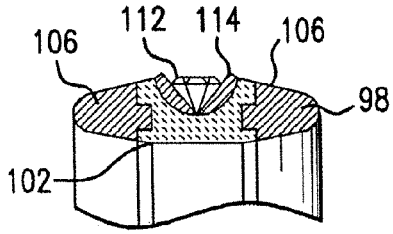

FIGS. 12-14 illustrate alternative embodiments in accordance with the present invention, wherein the hard metal or ceramic components are formed by two or more parts that are affixed together. For example, in FIG. 12, complementary annular sintered or ceramic parts 86 and 88 are provided with shallow bores 90 at several points around facing surfaces of the components, and a plurality of annular components 92 made of at least two materials 92 are sandwiched together and bored at intervals matching the bores 90, such that pins 94 may be extended through the bores in the ring components 92 with the ends thereof being extended into the bores 90 of the hardened ring components 86 and 88 to lend mechanical stability to the assembly. The various components 92 would, of course, be epoxied or otherwise bonded together.

In FIGS. 13 and 14, three-part ring assemblies are illustrated at 96 and 98 respectively, with each being comprised of a central band 100 and 102 respectively, sandwiched between and mechanically bonded to a pair of exterior rings 104 and 105 respectively. In the case of the ring assembly illustrated in FIG. 13, for example, the exterior components 104 might be of sintered metal or of ceramic while the interior band 100 might be of a precious metal, or even of a ceramic or sintered material. In the illustrated configuration, pockets 108 and azure holes 109 are formed in the interior band to receive gemstones 110 which are appropriately secured therein.

In the embodiment of FIG. 14, the interior band is depicted as being of a ceramic material sandwiched between and mechanically interlocked to exterior bands 106 made of sintered material or even precious metal, while the gemstones 112 are set in a precious metal 114.

Figure 15:
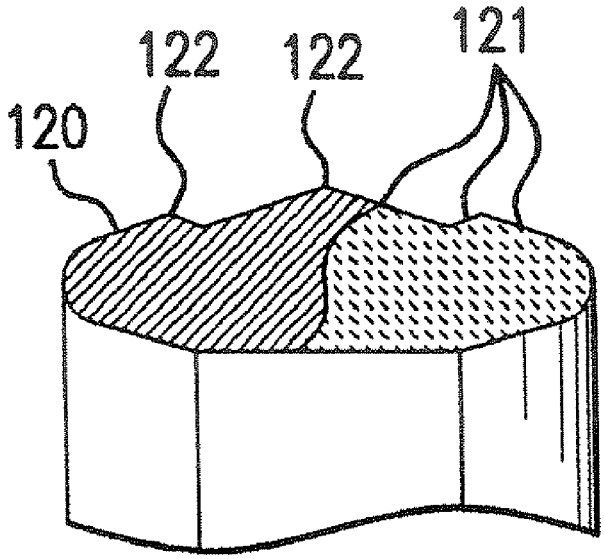
FIG. 15 illustrates a unitary multifaceted hard metal/ceramic ring.

FIG. 15. depicts at 120 a multifaceted unitary ring configuration made of a single, hard metal or ceramic substance. The six highly polished facets 121 on the outer surface of the ring create a unique design and visual impression heretofore not possible using prior art rings making techniques and technologies, because if such configuration had been made, the peaks 122 would have quickly been eroded, destroying the esthetic appearance of the ring.

Figure 16:
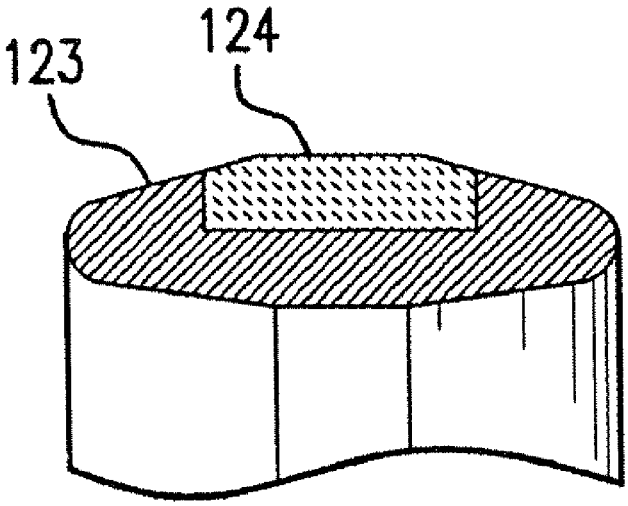
FIG. 16 depicts a precious metal ring having a hard metal/ceramic band embedded therein to provide a protective outer wear surface.

In FIG. 16 of the drawing, still another alternative embodiment is depicted wherein a ring made primarily of precious metal 123 includes an annular insert 124 embedded therein and extending above the uppermost surface of the precious metal component to provide a protective and esthetically pleasing insert.

Alternatively, one or more holes or cavities may be provided around the ring for receiving precious metals and/or set stones.

The principal concept of this invention is the provision of an ultra durable hard metal or high tech ceramic type of jewelry that may or may not incorporate precious metals and/or precious gem stones. The invention also provides a unique jewelry manufacturing process that combines hard metals with precious metals in a manner such that the precious metals are flush or recessed slightly below the outer most surfaces of the hard metals over the outer wear surfaces to achieve maximum abrasion and corrosion resistance. This is not to preclude the use of protruding precious metal or gemstone components, but in such cases the protruding components would not be protected by the harder materials. The invention involves the provision of jewelry items made from super hard metals such as tungsten and cemented carbide and high tech ceramics of various colors processed into a predetermined shape then sintered in a furnace and ground and polished into finished form. Such polished tungsten carbide jewelry articles have a grey color and a reflective mirror finish. These items may be shaped into concentric circular ring shapes of various sizes and profiles or individual parts may be ground into shapes that can be bonded to a precious metal substrate so as to protect the softer substrate. The hard metal circular designs encompass all types of profiles and cross-sectional configurations for rings, earrings and bracelets. Hard metal items may be processed with various sized and shaped openings distributed around the perimeter, with other objects of precious metal gem stones or the like secured into the various openings for cosmetic purposes. Gem stones set in precious metal may be secured into said openings for protection from scratching and daily wear.

Another configuration similar to that depicted in FIG. 11 might include several concentric rings of varying widths and thickness of precious metal or other material sandwiched between concentric rings of varying widths, thicknesses and profiles of hard metal. The components are assembled and bonded together with the softer precious metal surfaces being recessed below the adjacent surfaces of the hard metal, thereby causing all of the outer wear surfaces to be protected by the super hard metals surfaces.

Annular rings, earrings and bracelets may also be fashioned by combining variations of precious metal bands with the protective hard metal individual parts bonded onto and into slots or grooves or flat areas of the substrate precious metal bands. These hard metal parts will be positioned to give maximum protections to the precious metal parts. Articles of jewelry may be created using symmetrical or asymmetrical grid-type patterns. Machined hard metal parts of varying shapes and sizes may be assembled and bonded onto or into a precious metal substrate designed where precious metal is recessed for maximum durability. Articles of jewelry in accordance with the present invention may be made with various types of hard metals and precious metals where the hard metal is used for both esthetic and structural strength purposes. Hard metal rods of varying shapes and sizes maybe used in conjunction with precious metals to create a unique jewelry design having a very high structural strength. Articles of jewelry may be made entirely of hard metal or a combination of hard metal and precious metal where the cosmetic surfaces of the hard metal are ground to have a faceted look. These hard metal parts will be positioned to give maximum protections to the precious metal parts.

Articles of jewelry may be created using symmetrical or asymmetrical grid-type patterns. Machined hard metal parts of varying shapes and sizes may be assembled and bonded onto or into a precious metal substrate designed where precious metal is recessed for maximum durability.

Articles of jewelry in accordance with the present invention may be made with various types of hard metals and precious metals where the hard metal is used for both esthetic and structural strength purposes. Hard metal rods of varying shapes and sizes may be used in conjunction with precious metals to create a unique jewelry design having a very high structural strength. Articles of jewelry may be made entirely of hard metal or a combination of hard metal and precious metal where the cosmetic surfaces of the hard metal are ground to have a faceted look. These facets are unique to hard metal configurations in that precious metal is too soft and facet edges formed in such soft metals would wear off readily with normal everyday use.

The present invention has been described above as being comprised of a molded hard metal or ceramic component configured to protect a precious metal or other component; however, it will be appreciated that the invention is equally applicable to a multifaceted, highly polished jewelry item made solely of the hard metal composition or ceramic composition.

Furthermore, the present invention relates to a method of making jewelry wherein a rough molded and sintered part is subsequently machined to produce multiple facets and surfaces that can be highly polished to provide an unusually shiny ring surface that is highly resistant to abrasion, wear and corrosion. As used in this description, the term facet is intended to include both cylindrical and frusto conical surfaces as well as planar or flat surfaces. Having now described several embodiments of the invention, we now highlight a few exemplary embodiments of the invention.

In a first aspect, the invention provides an article, such as an item of jewelry, made of material selected from the group consisting of sintered metals and ceramics and having at least one highly polished facet formed on an outer surface thereof. In a second aspect, the invention provides an item of jewelry configured as an annular band having at least one annular groove formed in the outermost surface thereof and includes an insert of precious metal disposed within the groove. In a third aspect, the invention provides an item of jewelry wherein the outer surface of the inset of precious metal is recessed below adjacent extremities of the annular band. In a fourth aspect, the invention provides an item of jewelry wherein at least one gemstone is set in the insert of precious metal, the outermost surface of the gemstone being recessed beneath the adjacent extremities of the annular band. In a fifth aspect, the invention provides an item of jewelry wherein at least one gemstone is set in the insert of precious metal. In a sixth aspect, the invention provides an item of jewelry wherein at least one gemstone is set in a cavity in the band. In a seventh aspect, the invention provides an item of jewelry configured as an annular band embedded in a concentric band of precious metal and having its outermost circumference protruding above the outermost circumference of the concentric band. In an eighth aspect, the invention provides an item of jewelry wherein the annular band is comprised of at least two components axially separated by and joined together by at least one annular band of precious metal. In a ninth aspect, the invention provides an item of jewelry wherein the axially separated annular bands are joined together by a plurality of concentric annular bands made of disparate materials. In a tenth aspect, the invention provides an item of jewelry wherein the annular band includes at least two grooves formed in the outer surface thereof, the two grooves being at least partially filled with a material other than that of the annular band.

In an eleventh aspect, the invention provides a method of providing an article, such as for example, an item of jewelry, where the method comprises the steps of: providing a pressure mold having a cavity of predetermined configuration formed therein; providing a mixture of two or more powdered materials that can be solidified upon the application of pressure and heat; depositing a predetermined quantity of the mixture of powdered materials within the cavity; compressing the quantity of powdered material to form a blank; and sintering the blank to form at least a component of the item of jewelry. This method may further be defined such that the item of jewelry is in the form of an annular band having a groove formed in the outer surface thereof, and further comprising the step of affixing a material within the outer groove, the outer surface thereof being recessed beneath the bounding edges of the groove. This method may be even further defined such that the affixed material is a precious metal that is affixed to the annular ring by brazing. The method may optionally be further defined such that the affixed material is affixed to the annular blank through the use of resinous materials. In a fifteenth aspect, the method may also include the step of finish polishing at least one surface of the annular blank. The method may be further defined such that the annular band has a plurality of facets formed in an outer surface thereof. In a seventeenth aspect, the invention may be further defined such that the affixed material is affixed to the annular blank by a mechanical interlocking of parts. In yet an eighteenth aspect, the inventive method may provide that the blank is severed to form a plurality of sub-blanks, each forming at least a component of the item of jewelry. In a nineteenth aspect, the method may further comprise affixing a gemstone or piece of precious metal to the item of jewelry. In another aspect, the method is further defined such that the component has a plurality of facets formed in an outer surface thereof.

While the certain embodiments of the article and method have been described with particular emphasis on jewelry items and articles, it is understood that neither the inventive article nor the apparatus or method for making the inventive article are limited to jewelry items but extends to all articles having the physical and materials properties described herein.

ALTERNATIVE EMBODIMENTS

The invention also provides system, apparatus, and method or process for creating objects or articles, particularly composite articles, using wear-resistant or other materials, such as tungsten-carbide, poly or mono crystalline ceramics, and mixtures or alloys thereof. In one embodiment, the process is directed to the manufacture of articles having a circular, spherical, or cylindrical cross-section, such as items of jewelry or rings. In some embodiments, the circular, spherical or cylindrical article will be combined with other shapes and/or deformed after fabrication so that the final article has a different shape than circular, spherical or cylindrical. The manufactured articles, particularly items of jewelry items, typically have inlays of a precious metal, such as gold, platinum, or alloys thereof Characteristics and examples of some such articles and materials have been described elsewhere in the specification. However, it will be clear that the process described is not limited to the manufacture of items of jewelry, but may generally be applied to fabricating a variety of articles.

In a first embodiment of a process according to the present invention, a procedure is provided that permits the inlay of a metal having a lower melting point into one or more grooves or depressions in an underlying support or substrate. For example, the procedure is applicable to inlaying a precious or semi-precious metal such as gold into a groove in a sintered tungsten-carbide or ceramic ring. By lower melting point it is meant a metal (or alloy) having a temperature of fusion that is low relative to that of the material of the substrate.

Figure 17:
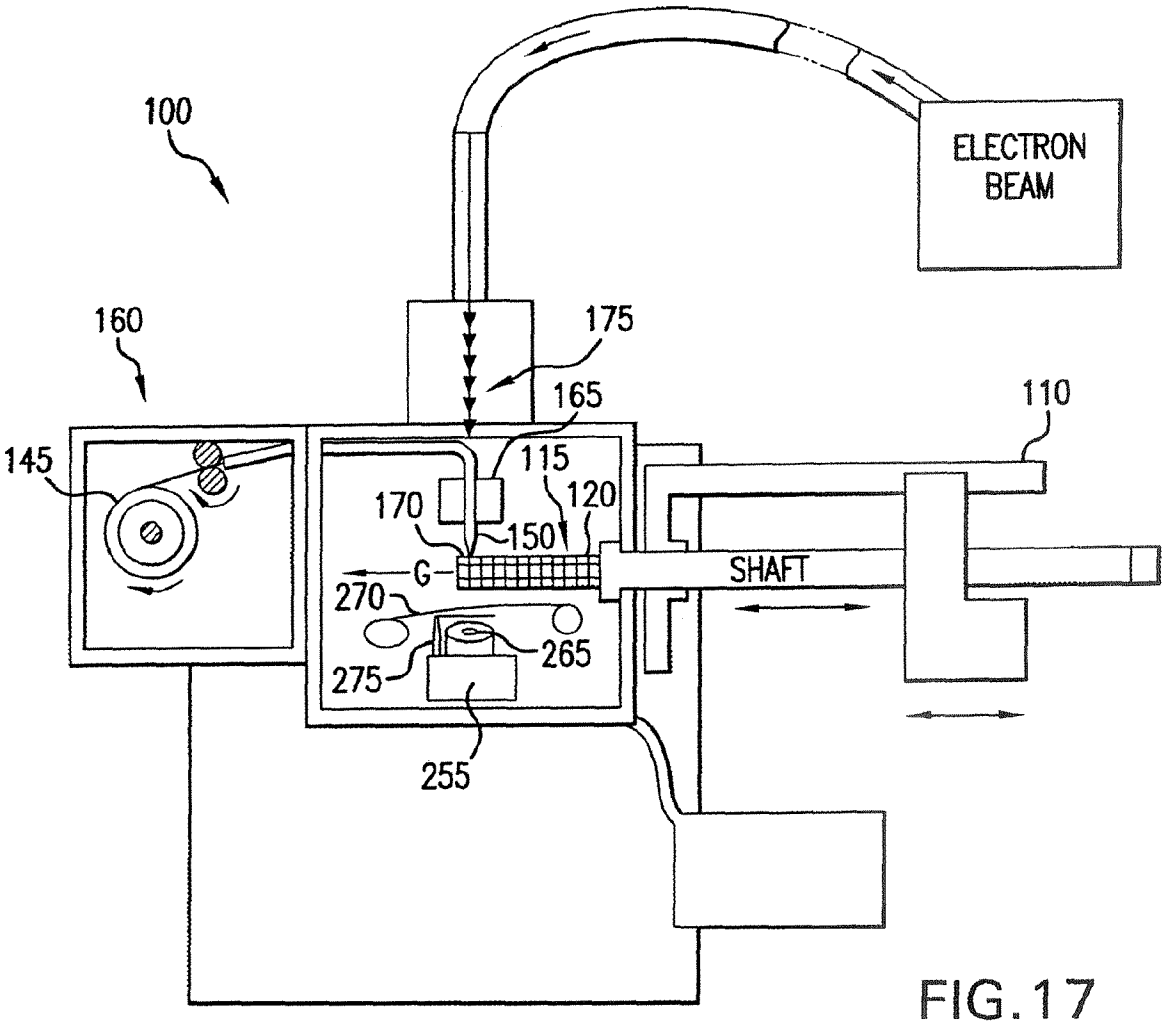
FIG. 17 is a schematic side view of an embodiment of an apparatus for forming an article according the present invention.
Figure 18:
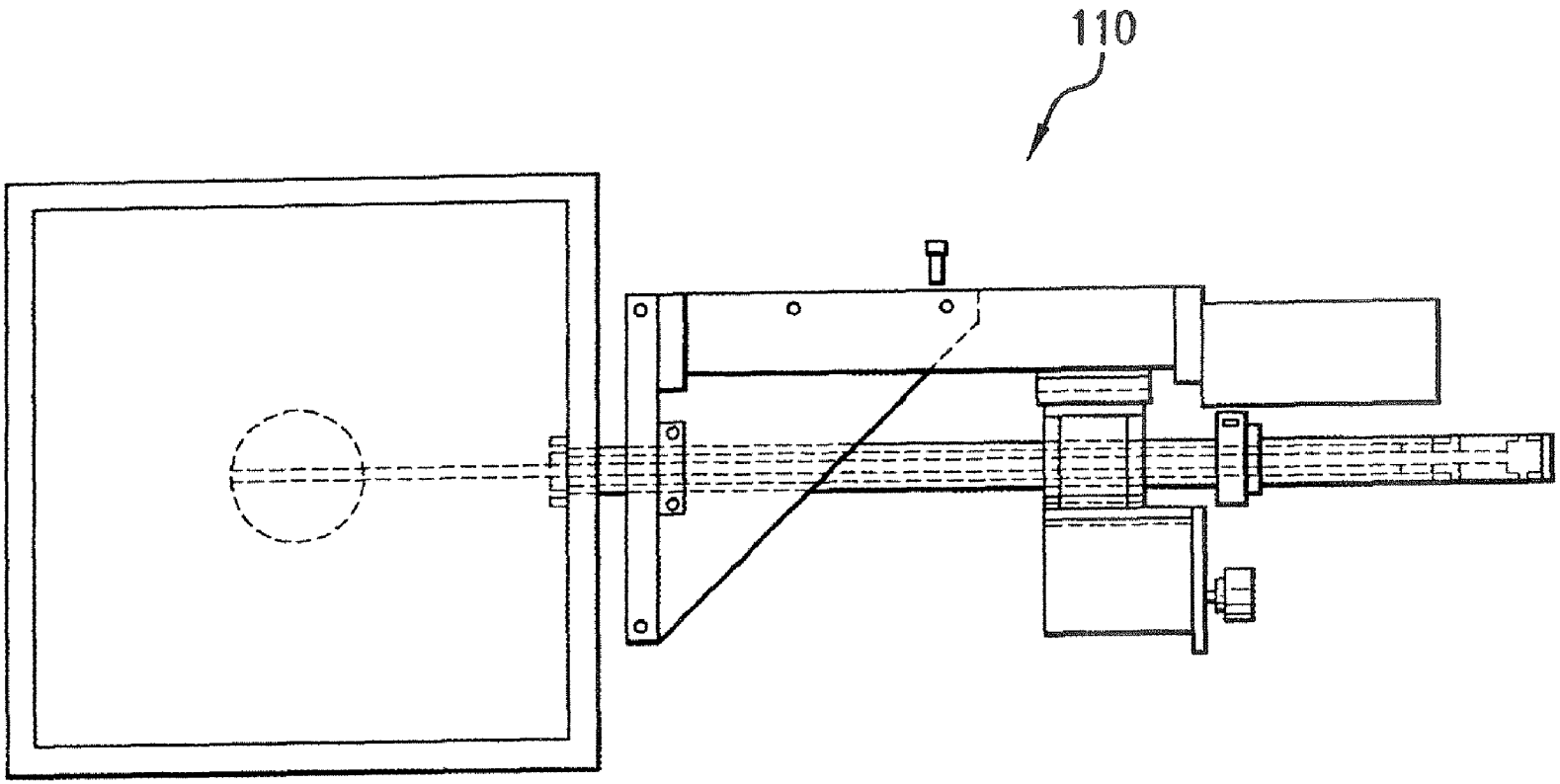
FIG. 18 is a schematic side view of an embodiment of an indexer of the apparatus of FIG. 17.
Figure 19A:
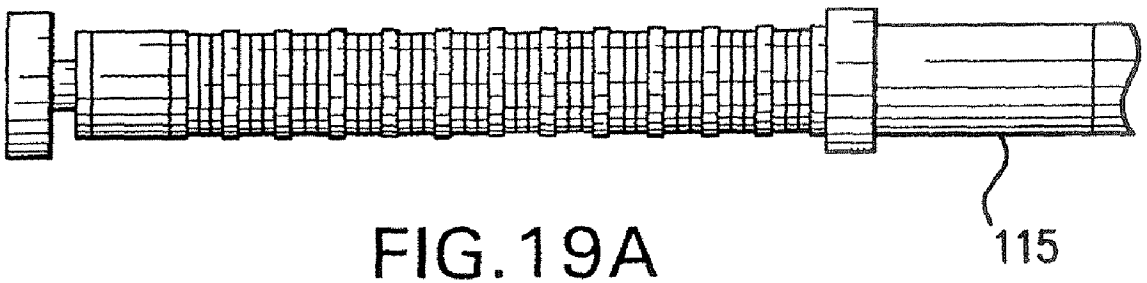
FIGS. 19A and 19B are schematic side views of an embodiment of a mandrel for holding substrates in the apparatus of FIG. 17.
Figure 19B:
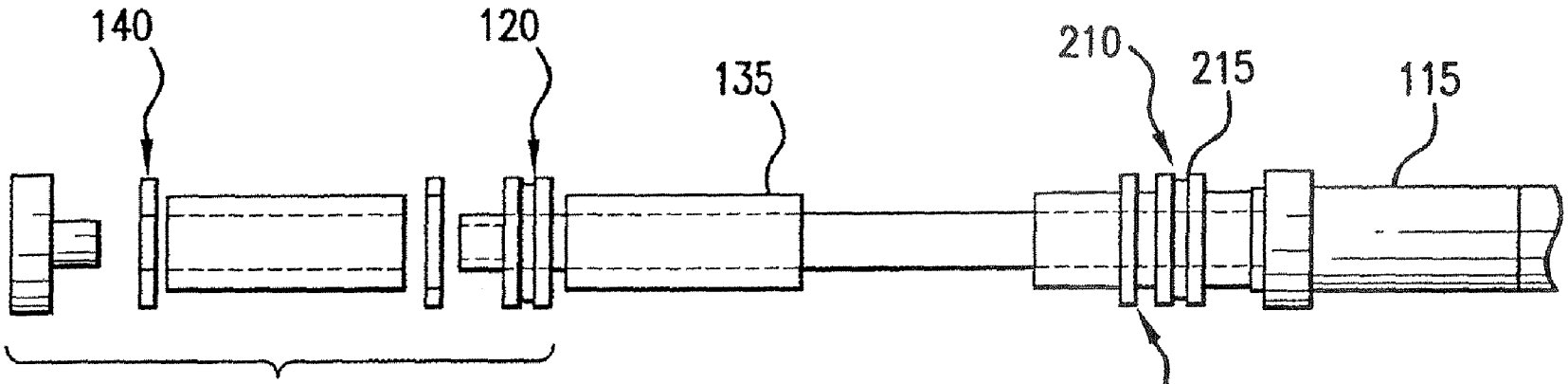
Figure 20:
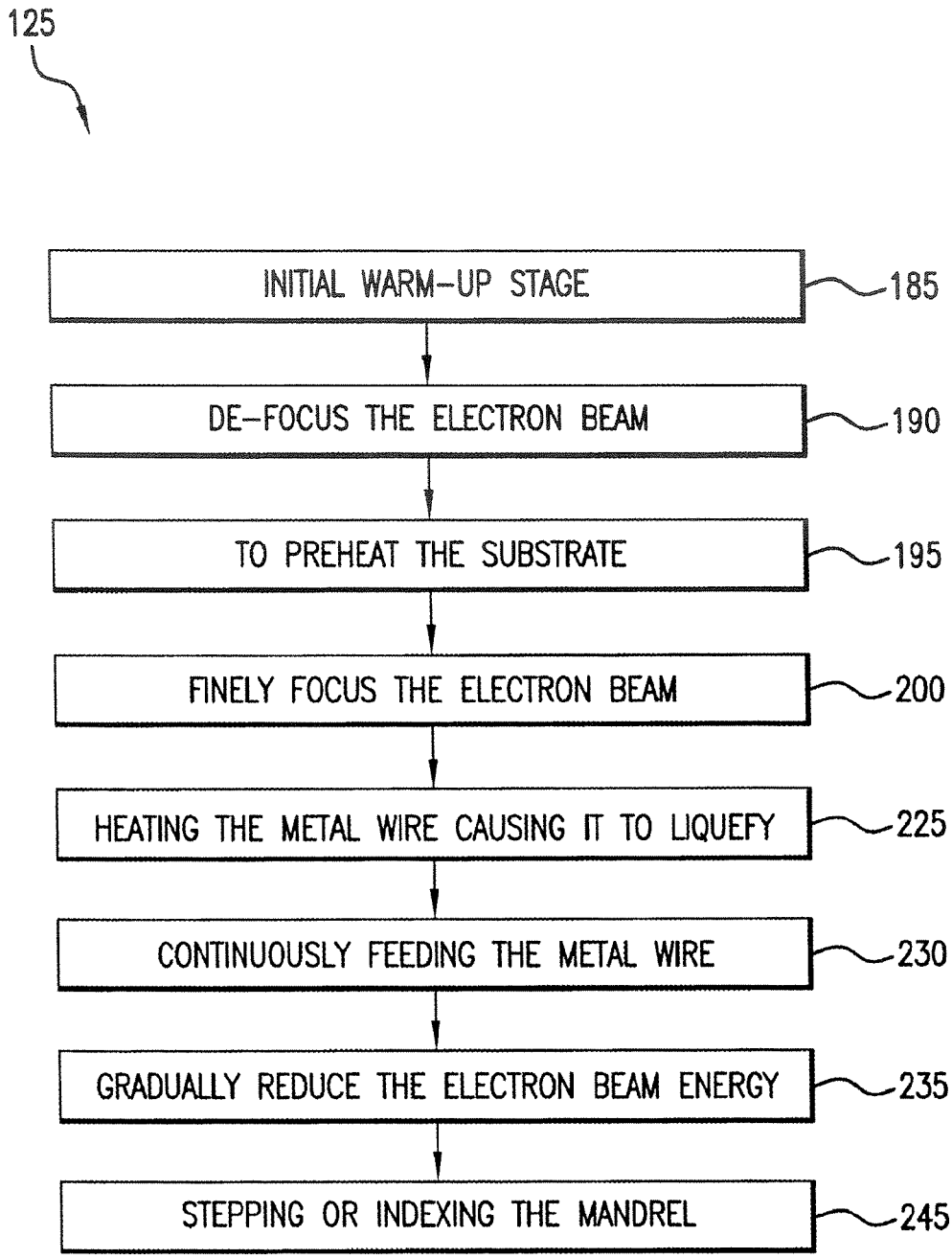
FIG. 20 is a flowchart of an embodiment of a process for manufacturing an article according to an embodiment of the present invention.

An apparatus and process for manufacturing an article according to the present invention will now be described with reference to FIG. 17 through FIG. 20. FIG. 17 is a schematic side view of an embodiment of a vacuum deposition system 100 for forming an article 105 according the present invention. FIG. 18 is a detailed view of an indexer 110 of the system 100 of FIG. 17. FIGS. 19A and 19B are schematic side views of an embodiment of a mandrel 115 for holding substrates 120. FIG. 20 is a flowchart of an embodiment of a process 125 for manufacturing an article 105 according to an embodiment of the present invention.

The process 125 involves rotating a substrate 120 of the article 105 being manufactured, such as a ring-shaped substrate, inside the vacuum deposition system 100 where a liquid cooled mandrel 115 covered by an electrically conductive sheath 135. In one embodiment, a number of substrates 120 are stacked along the mandrel 115 with thin washer shaped separators 140 to provide alternating substrate, separator, substrate, and the like. The electrical conductive sheath 135 can be made, for example, of extruded graphite or a metal-coated ceramic material such as aluminum oxide or mulite.

A spool 145 of metal wire 150 contained within the deposition system 100 is delivered via a delivery mechanism 160 through a nozzle 165 just behind a point or location 170 where an electron beam 175 (e-beam) is focused to strike the rotating substrate 120.

During an initial warm-up stage (Step 185) of the process 125 the electron beam 175 is deliberately de-focused (Step 190) to preheat (Step 195) the substrate 120. Typically the substrate 120 is preheated to a temperature of between about 300 to about 600.degree. F. (150 to 300.degree. C.).

After preheating, the electron beam 175 is finely focused (Step 200) at a focal point 205 coincident with the width of a grooved portion 210 having a recessed groove 215 or depression on a surface of the substrate 120. Simultaneously, the metal wire 150 is fed through the nozzle 165 into the path of the focused electron beam 175, and as a result of the impact of the electrons from the electron beam, heated causing it to virtually instantaneously liquefy (Step 225) and flow into the groove 215 of the substrate 120. Wire 150 is continuously fed and heated until an adequate amount of metal has been deposited or applied to the groove (Step 230). The energy in electron beam 175 is then gradually reduced (Step 235) to allow solidification of the metal in the groove 215 and cooling of the article 105.

The mandrel 115 is then stepped or indexed (Step 245) using the indexer 110 shown in FIG. 18 to a center of the grooved portion 210 of the next substrate 120, and the process 125 repeated (Steps 185 to 245) until all substrates have been metallized, that is until all substrates have had metal deposited into the groove 215.

Preferably, a temperature sensor 255, such as an optical pyrometer, is provided within vacuum deposition system 100 to read the temperature of the substrate 120 and to provide the temperature to a control program (not shown) that precisely controls the delivery mechanism 160, indexing of the indexer 110 and the power and focus of the electron beam 175 to produce an article 105 having a uniform and seamless band of metal about the substrate 120. Alternatively, if the degree of uniformity is not critical, a simple open loop control (not shown) in which the metal wire 150 is fed at a constant rate, the indexer 110 indexed, and the electron beam 175 is powered up and focused at regular intervals, can be provided rather than the feedback control using temperature, but is not preferred.

Because a sensing lens 265 or window of the temperature sensor 255 is susceptible to metal deposition resulting from vaporization of some of the molten metal in the vacuum deposition system, a lens shield 270 may advantageously be interposed between the sensing lens 265 and the substrate 120. The shield 270 can be made from Mylar or other clear (optically transparent) material placed in between the sensing lens 265 and the substrate 120. Preferably, the lens shield 270 is a thin strip or tape of material which is continuously moved past sensing lens 265 of the temperature sensor 255 during the metallization process 125, thus allowing the temperature sensor to always read the temperature accurately. Alternatively or in addition thereto, the sensor lens 265 may be covered by a shutter or other movable cover 275 so that the sensor lens is covered at all times while liquid or gaseous metal is present in the system 100. The cover 275 is moved away from the sensor lens 265 during the preheating phase (step 195) to ensure that preheat temperature is reached before the metallization step begins.

As already described, this first process 125 for depositing a layer of material having a lower melting point than the substrate 120 can only be used with certain materials. When the melting temperature of the inlay material is higher than the substrate 120, heating the substrate and/or depositing the molten metal may, at the very least, damage or deform the substrate. Hence, an alternative second process 285 has been developed for inlaying materials having a high melting temperature, such as platinum, or alloys thereof, onto a substrate 120. Such high temperature materials cannot be directly melted into the groove 215 by the first process 125 described above because their melting temperature is as high or higher than the sintering temperature or temperature of fusion of the substrate. This second process 285 can also be used where the melting temperature of the inlay material is below the melting or sintering temperature of the substrate 120.

The second process 285 involves the fabrication of the article 105 using swaging and braising operations. Generally, the metal wire 150 is soldered or welded to form a joint-less metal ring 290 (or otherwise fabricating or machining to form a seamless metal ring or other article) that is then squeezed or swaged onto a sintered substrate 120. A braising material (not shown) having a melting point lower than both the metal ring 290 and the substrate 120 is applied to a junction (not shown) between the metal ring and the substrate to wick into the junction by capillary action, thereby forming a solid unitary article 105 having substantially no gaps or interstitial recesses between the metal ring and the substrate.

Figure 21:
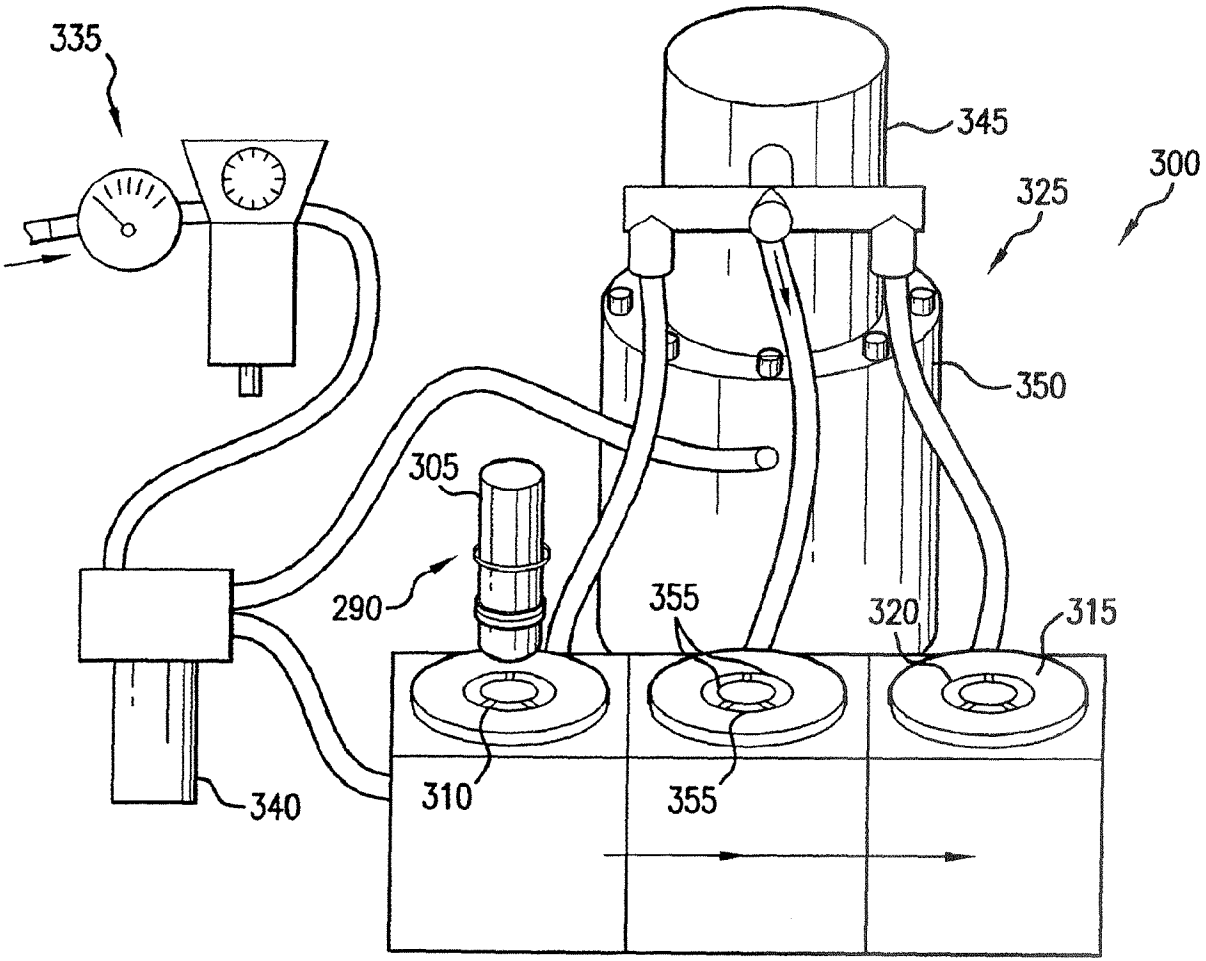
FIG. 21 is a schematic side view of another embodiment of an apparatus for forming an article according the present invention.

FIG. 21 shows a schematic diagram of an exemplary embodiment of a mechanical press 300 suitable for swaging or squeezing the metal ring 290 onto the substrate 120 according the second process 285 of the present invention. The press 300 generally includes several rods or mandrels 305 to hold the substrate 120 with the metal ring 290 disposed thereabout, one or more threaded, tapered top collets 310 into which the mandrel is placed, one or more collet-blocks 315 having tapered openings 320 into which the collet is forced to squeeze or swage the metal ring to the substrate and a pneumatic or hydraulic power cylinder 325 to force the collet into the opening in the collet block. In operation, air or hydraulic fluid from a pressurized supply 335 is admitted to the power cylinder 325 through a manual or electronic valve 340. In the embodiment shown in FIG. 21 the press 300 further includes a hydraulic fluid cylinder 345 to which air is applied and a pneumatic multiplier 350 to convert the relatively low pressure air to a higher hydraulic fluid pressure. Pneumatic multipliers 350 typically raise the pressure of a hydraulic fluid to a pressure from 4 to 12 times that of the pneumatic air. For example, supplying 50 pounds per square inch (psi) of air can produce 600 psi in a hydraulic fluid supplied to the collet-blocks 315.

Figure 22:
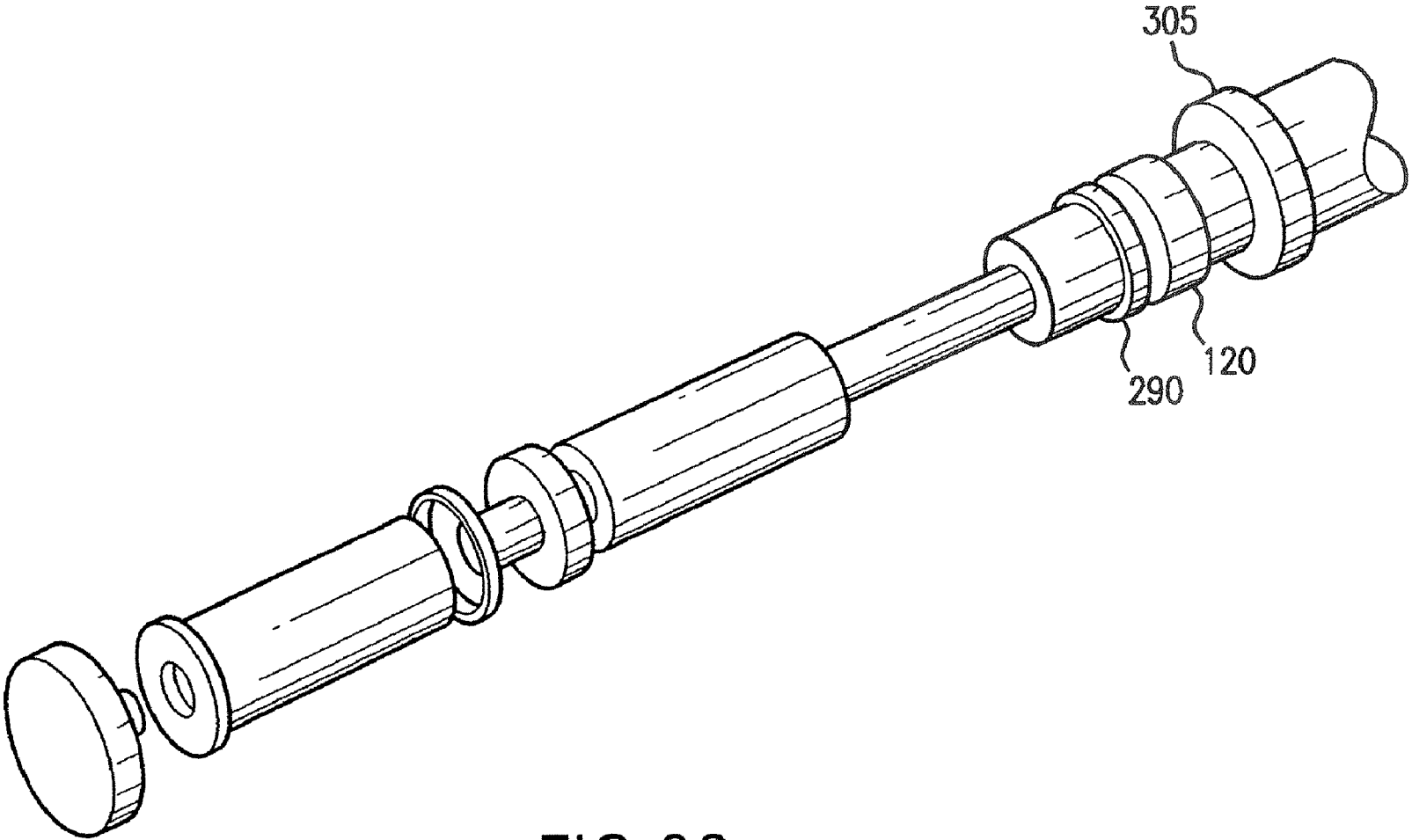
FIG. 22 is a schematic side view of an embodiment of a mandrel for holding substrates in the apparatus of FIG. 21.

Preferably the mandrel 305, shown in detail in FIG. 22, has an outer diameter (OD) sized to re-enforce or support the substrate 120 during the manufacturing process 285. More preferably, the mandrel 305 is of an expanding type that has an OD that can be adjusted to be substantially the same as the inner diameter (ID) of the substrate 120 to apply a counter-force directed radially outward from the substrate thereby preventing it from deforming or cracking when force is applied to the OD of the substrate.

The top collets 310 have a generally hollow cylindrical shape and are threaded at one end to engage a threaded fitting inside the opening 320 in the collet-blocks 315. The collets 310 are tapered from an OD larger than the metal ring 290 to a minimum OD near the threaded end, and are segmented axially to form three or more arcuate prongs or tines 355 that are deformed radially inward as the top collet is pulled into the opening 320 in the collet-block 315. The collet-block 315 also tapers from an ID slightly larger than the OD of the metal ring 290 to an minimum ID slightly smaller than the OD of the substrate 120. As the top collet 310, with the mandrel 305 positioned therein, is pulled into the opening 320 in the collet-block 315, the arcuate tines 355 of the collet move radially inward to swage the metal ring 290 to the substrate 120. This can be accomplished either by pulling the top collet 310 down through the opening 320 in the collet-block 315 or by raising the collet-block over the top collet.

Figure 23:
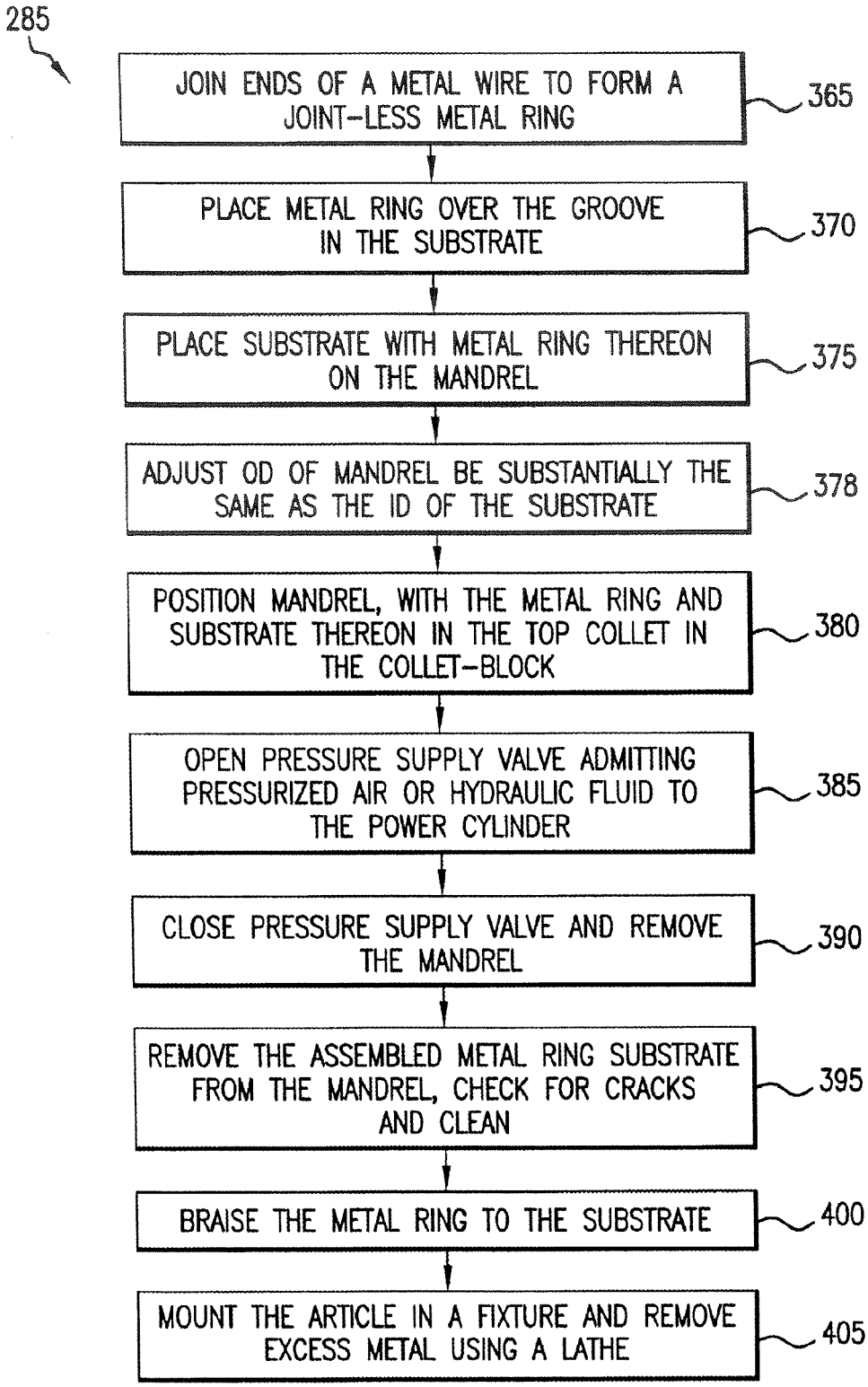
FIG. 23 is a flowchart of an embodiment of another process for manufacturing an article according to an embodiment of the present invention.

A process for manufacturing an article 105 according to the present invention will now be described with reference to FIG. 23. FIG. 23 is a flowchart of steps for manufacturing the article according to the second process 285.

In an initial step, (step 365) ends of a metal wire are joined and soldered to form a joint-less metal ring 290 having an ID larger than an OD of the substrate 120. The metal ring 290 is placed over the groove 215 in the substrate 120. (step 370). The substrate 120, with the metal ring 290 assembled thereon, is then place on the mandrel 305. (step 375). Optionally, if the mandrel 305 is of the expanding type, the OD of the mandrel adjusted to be substantially the same as the ID of the substrate 120. (step 378) The mandrel 305, with the metal ring 290 and substrate 120 assembly thereon is positioned in the top collet 310 in the collet-block 315. (step 380). The pressure supply valve 340 is opened admitting pressurized air or hydraulic fluid to the power cylinder 325 forcing the top collet 310 through the opening 320 in the collet-block 315 and swaging the metal ring 290 to the substrate 120. (step 385). The pressure supply valve 340 is closed and the mandrel 305 removed. (step 390) In a preferred embodiment, the process 285 is a multi-step process in which the top collet 310 with the mandrel 305 therein is moved through a sequence of collet-blocks 315 having successively smaller minimum ids so as to yield a snug fit of the metal ring 290 onto the substrate 120. For example, in the embodiment of the mechanical press 300 shown in FIG. 21, the process can be a three step process in which the three collet-blocks 315 shown have openings 320 that are large, medium or small relative to one another.

After the metal ring 290 is swaged to the substrate, the assembly is removed from the mandrel 305, optionally but desirably checked for cracks and then cleaned (step 395) prior to beginning the braising process.

A preferred braising process (step 400) uses an electron beam 175 similar to that described above in the first process 125 but substituting silver, gold or a eutectic alloy wire 150 as a braising material to bond the metal ring 290 and the substrate 120 together rather than to fill the groove 215.

In an alternative braising step (not shown), the braising can be accomplished by applying a braising material near the groove 215 in the assembled metal ring 290 and substrate 120 and heating the assembly in a vacuum chamber or other oxygen free environment. The assembly is slowly raised to the proper temperature and then slowly cooled to complete the braising operation. In yet another alternative braising step (not shown), the braising can be accomplished by depositing a thin strip or small amount of braising material in the groove 215 prior to the swaging operation and then heating the assembly as described above.

After the metallizing process (steps 365 to 400) is completed, the article 105 is mounted into a fixture (not shown) in a lathe (not shown) and the excess metal removed. (step 405).

Although described relative to a process for flowing molten precious or semiprecious metal into a groove 215 in a ring-shaped substrate 120, the inventive process 125 is not so restricted. It may, for example, be utilized for any application in which it is desired to deposit one metal material onto a substrate, independent of the form or composition of the substrate. Examples of such alternative applications include: medical devices and implants, dental devices and implants, industrial and electronic devices and components, and so forth.

It is to be understood that even though numerous characteristics and advantages of certain embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

Although the invention has been disclosed herein in terms of several preferred embodiments, it is anticipated that after having read the above disclosure, it will become apparent to those skilled in the art that various alterations and modifications could be made. It is therefore my intent that the following claims be interpreted as covering all such alterations and modifications as fall within the true spirit and scope of the invention.

What is claimed is:

1. A method of making a finger ring which comprises:

providing an annular finger ring that defines an aperture configured and dimensioned to receive a person's finger and which comprises a sintered mixture of at least two powdered materials comprising tungsten and a binder component in a relatively lesser amount than an amount of tungsten, with the annular ring having at least one external facet.

2. The method of claim 1, wherein the sintered mixture comprises at least 85 weight percent tungsten.

3. The method of claim 1, wherein the providing step comprises:

compressing the mixture of at least two powdered materials into a blank; and sintering the blank into an annular finger ring.

4. The method of claim 1, further comprising:

shaping the at least one external facet into a predetermined shape; and providing a finish to at least a portion of the finger ring, wherein the sintered mixture retains the predetermined shape and finish for the lifetime of the jewelry ring.

* * * * *